US007576711B2

(12) United States Patent
An

(10) Patent No.: US 7,576,711 B2
(45) Date of Patent: Aug. 18, 2009

(54) CONTRAST COMPENSATING APPARATUS FOR PDP MODULE AND METHOD THEREOF

(75) Inventor: Byung Soo An, Daegu (KR)

(73) Assignee: LG Electronics Inc., Seoul (KR)

( * ) Notice: Subject to any disclaimer, the term of this patent is extended or adjusted under 35 U.S.C. 154(b) by 759 days.

(21) Appl. No.: 11/045,121

(22) Filed: Jan. 31, 2005

(65) Prior Publication Data

US 2005/0190121 A1 Sep. 1, 2005

(30) Foreign Application Priority Data

Jan. 30, 2004 (KR) ..... 10-2004-0006095

(51) Int. Cl.
*G09G 3/28* (2006.01)

(52) U.S. Cl. ..... 345/60; 345/61; 345/62; 345/690

(58) Field of Classification Search ..... 345/60–62, 345/690

See application file for complete search history.

(56) References Cited

U.S. PATENT DOCUMENTS

2005/0122287 A1* 6/2005 Nishitani et al. ..... 345/63
2006/0284899 A1* 12/2006 Kimura ..... 345/690
2007/0216816 A1* 9/2007 Aoki et al. ..... 348/674

FOREIGN PATENT DOCUMENTS

EP 1 014 330 A2 6/2000
EP 1 321 920 A1 6/2003

* cited by examiner

*Primary Examiner*—Richard Hjerpe
*Assistant Examiner*—Leonid Shapiro
(74) *Attorney, Agent, or Firm*—Birch, Stewart, Kolasch & Birch, LLP

(57) ABSTRACT

Disclosed is a contrast compensating apparatus for a PDP module and method thereof that can compensate for the deterioration of contrast due to the decrease of the number of sustain pulses according to an APL adjustment. The apparatus includes an APL calculating unit, a sustain pulse generating unit, a histogram analyzing unit for calculating a maximum value M of brightness repeating numbers of the video signal, a minimum brightness value W1 and a maximum brightness value W2 of a brightness repetition distribution area that includes the maximum value M of the brightness repeating numbers, a comparing unit, a contrast compensating unit for comparing an output of the comparing unit with a first setting value, comparing the maximum value of the brightness repeating numbers from the histogram analyzing unit with a second setting value, and calculating a contrast compensation value using the minimum brightness value W1 and the maximum brightness value W2 according to results of comparison, and a mixer for feeding an output of the contrast compensating unit back to an input terminal of the video signal.

4 Claims, 5 Drawing Sheets

CONTRAST COMPENSATING APPARATUS FOR PDP MODULE AND METHOD THEREOF

BACKGROUND OF THE INVENTION

1. Field of the Invention

The present invention relates generally to a PDP (Plasma Display Panel) module, and more particularly to a contrast compensating apparatus for a PDP module and a method thereof.

2. Description of the Related Art

Conventionally, in order to protect a PDP module, a scheme for keeping the power consumption of the PDP module has been used. In a PDP module, the number of sustain pulses is adjusted according to an average brightness level of a picture, i.e., APL (Average Picture Level). A relation between the APL and the sustain pulses is illustrated in FIG. 1.

As illustrated in FIG. 1, the APL is in inverse proportion to the number of sustain pulses. That is, in a section in which the APL is high, for example, in a 'C section', the APL is reduced by reducing the number of sustain pulses, while in a section in which the APL is low, for example, in an 'A section', the APL is increased by increasing the number of sustain pulses.

A conventional circuit for controlling the brightness of a PDP module by adjusting the number of sustain pulses according to the APL is illustrated in FIG. 2.

Referring to FIG. 2, the conventional brightness control apparatus for a PDP module includes an APL calculating unit 10 for calculating the APL of an input video signal, and a sustain pulse generating unit 11 for generating sustain pulses the number of which corresponds to the APL value output from the APL calculating unit 10 to provide the generated sustain pulses to a PDP module 12.

The conventional apparatus, however, has the drawbacks in that although it presents the maximum contrast by generating the maximum number of sustain pulses in a dark picture, it presents the minimum contrast by generating the minimum number of sustain pulses in a bright picture having a high APL, for example, in the 'C section' of FIG. 1, and thus the gradation reproduction cannot be accurately performed in a bright picture to deteriorate the picture quality.

SUMMARY OF THE INVENTION

The present invention is directed to a contrast compensating apparatus for a PDP module and a method thereof that substantially obviate one or more problems due to limitations and disadvantages of the related art.

It is an object of the present invention to provide a contrast compensating apparatus for a PDP module and a method thereof that can compensate for the deterioration of contrast due to the decrease of the number of sustain pulses according to an APL adjustment.

To achieve this and other objects and advantages in accordance with the purpose of the present invention, as embodied and broadly described herein, there is provided a contrast compensating apparatus for a PDP module comprising an APL (Average Picture Level) calculating unit for calculating an APL of a video signal, a sustain pulse generating unit for generating and providing sustain pulses the number of which corresponds to an output of the APL calculating unit to the PDP module, a histogram analyzing unit for calculating a maximum value M of brightness repeating numbers of the video signal, a minimum brightness value W1 and a maximum brightness value W2 of a brightness repetition distribution area that includes the maximum value M of the brightness repeating numbers, a comparing unit for comparing the output of the APL calculating unit with at least one brightness section threshold value and outputting a result of comparison, a contrast compensating unit for comparing an output of the comparing unit with a first setting value, comparing the maximum value of the brightness repeating numbers from the histogram analyzing unit with a second setting value, and calculating a contrast compensation value using the minimum brightness value W1 and the maximum brightness value W2 according to results of comparison, and a mixer for feeding an output of the contrast compensating unit back to an input terminal of the video signal.

Preferably, the contrast compensating unit calculates the contrast compensation value in a manner that it calculates a brightness difference between the minimum brightness value W1 and the maximum brightness value W2, reads a brightness compensation value corresponding to the calculated brightness difference with reference to a pre-stored brightness difference/compensation value table, and calculates brightness level increase/decrease values of corresponding pixels so that a brightness distribution area that includes the minimum brightness value W1 and the maximum brightness value W2 is shifted to a brightness repetition distribution area having a minimum value W1' and a maximum value W2' that are reduced as much as the brightness compensation value.

In another aspect of the present invention, there is provided a contrast compensating method for a PDP module comprising the steps of calculating an APL (Average Picture Level) of a video signal, a maximum value M of brightness repeating numbers of the video signal, a minimum brightness value W1 and a maximum brightness value W2 of a brightness repetition distribution area that includes the maximum value M of the brightness repeating numbers, primarily judging whether a contrast compensation of the present video signal is required according to the calculated APL, if the contrast compensation is required as a result of primary judgment, secondarily judging whether the contrast compensation of the present video signal is required according to the maximum value M of the brightness repeating numbers, if the contrast compensation is required as a result of secondary judgment, calculating a compensation value using the minimum brightness value W1 and the maximum brightness value W2, and performing the contrast compensation by feeding the calculated compensation value back to an input terminal of the original video signal.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings.

Figure 3:
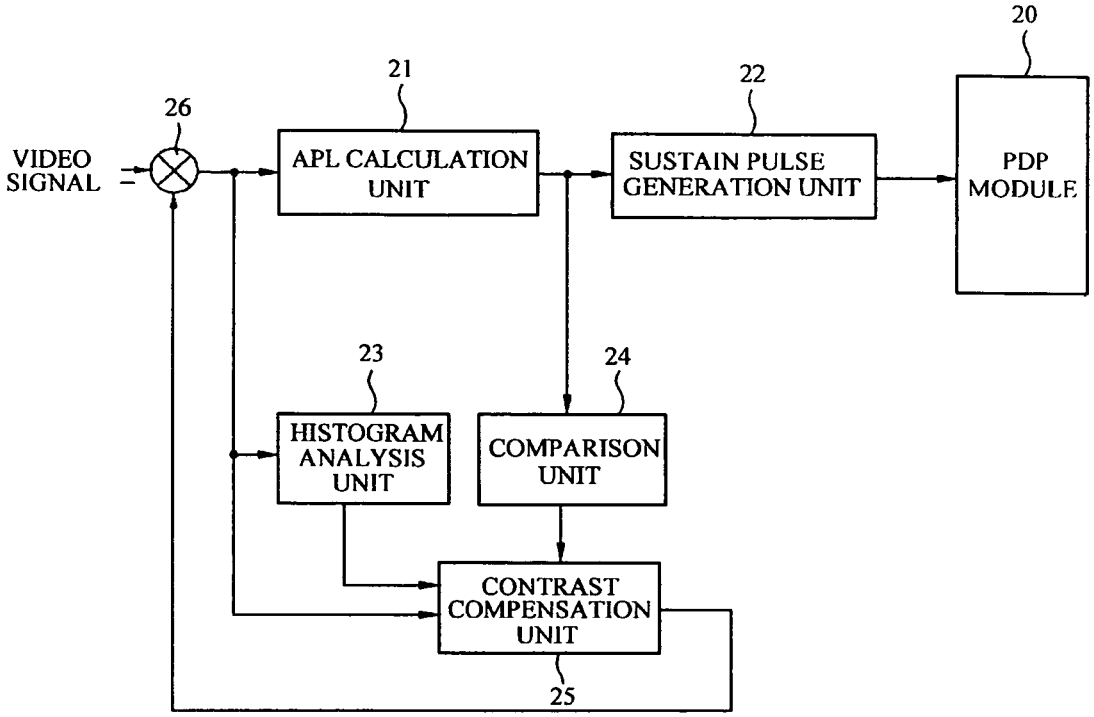
FIG. 3 is a block diagram illustrating the construction of a contrast compensating apparatus for a PDP module according to the present invention.
Figure 4:
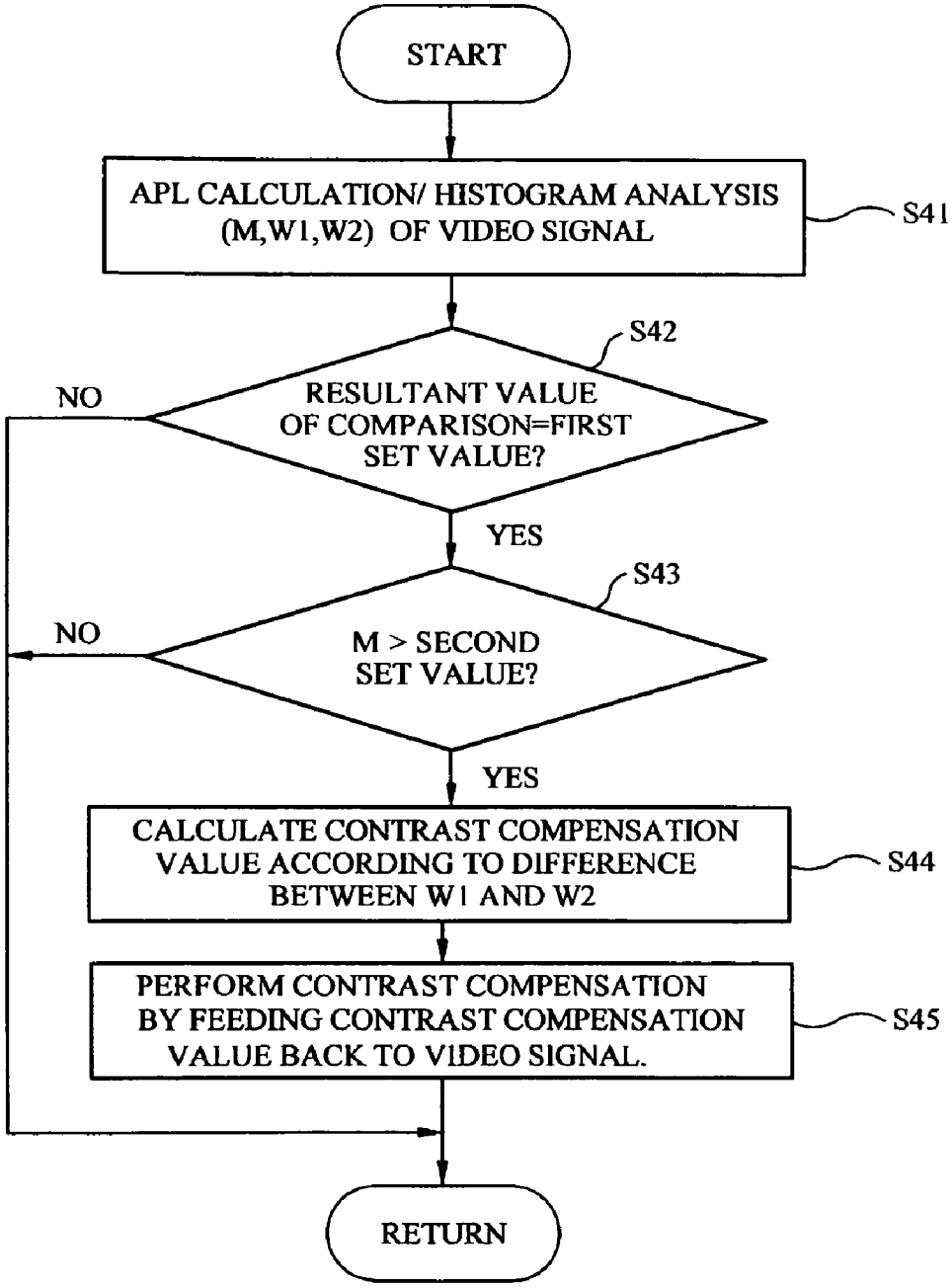
FIG. 4 is a flowchart illustrating a contrast compensating method for a PDP module according to the present invention.
Figure 5:
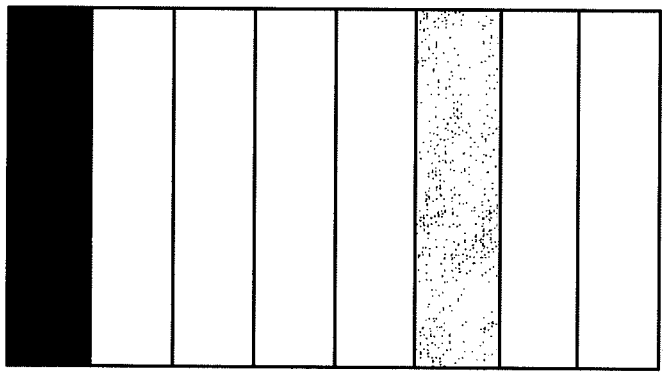
FIG. 5 is a view illustrating an example of a picture for a histogram.
Figure 6:
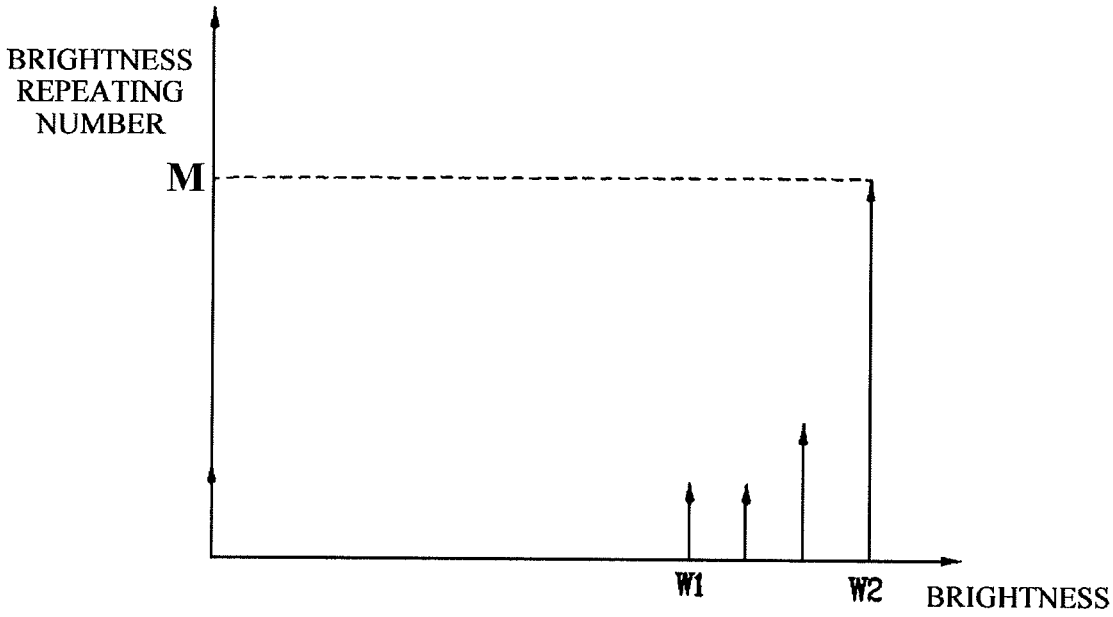
FIG. 6 is a graph illustrating a histogram according to the picture of FIG. 5.
Figure 7:
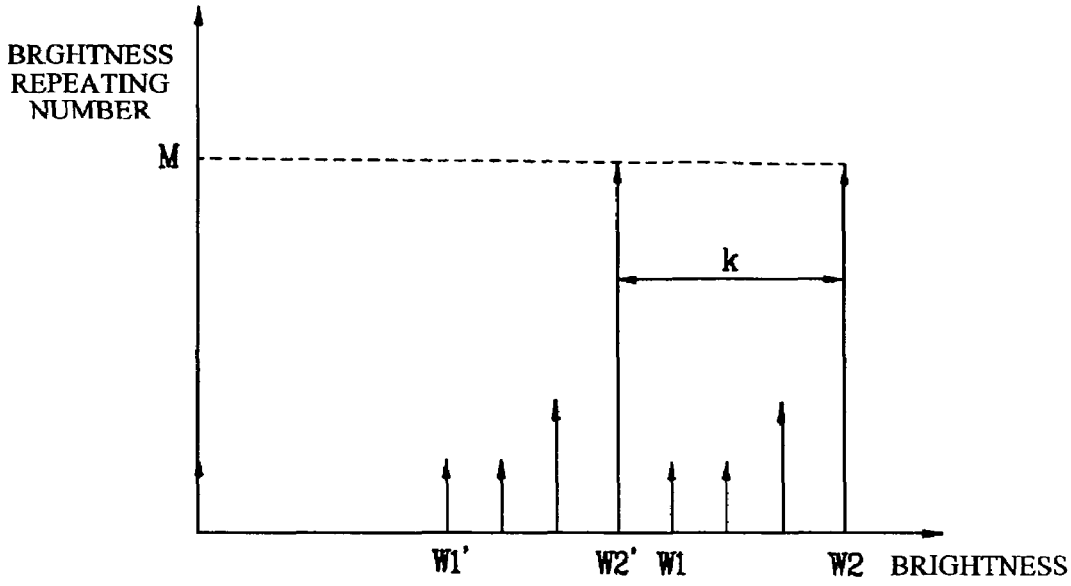
FIG. 7 is a graph illustrating a histogram in which the contrast compensation is performed according to the present invention.

FIG. 3 is a block diagram illustrating the construction of a contrast compensating apparatus for a PDP module according to the present invention, and FIG. 4 is a flowchart illustrating a contrast compensating method for a PDP module according to the present invention. FIG. 5 is a view illustrating an example of a picture for a histogram, FIG. 6 is a graph illustrating a histogram according to the picture of FIG. 5, and FIG. 7 is a graph illustrating a histogram in which the contrast compensation is performed according to the present invention.

The contrast compensating apparatus for a PDP module according to the present invention, as illustrated in FIG. 3, includes an APL (Average Picture Level) calculating unit 21 for calculating an APL value of a video signal, a sustain pulse generating unit 22 for generating and providing sustain pulses the number of which corresponds to an output of the APL calculating unit 21 to the PDP module 20, a histogram analyzing unit 23 for calculating a maximum value M of brightness repeating numbers of the video signal, a minimum brightness value W1 and a maximum brightness value W2 of a brightness repetition distribution area that includes the maximum value M of the brightness repeating numbers through a histogram of the video signal, a comparing unit 24 for comparing the output of the APL calculating unit 21 with at least one brightness section threshold value and outputting a result of comparison, a contrast compensating unit 25 for comparing an output of the comparing unit with a first setting value, and calculating a contrast compensation value using the minimum brightness value W1 and the maximum brightness value W2 according to a represents a frequency of each brightness value in the video signal, and thus the maximum value M result of comparison, and a mixer 26 for feeding an output of the contrast compensating unit 25 back to an input terminal of the video signal. The brightness repeating number of the video signal of brightness repeating numbers of the video signal is the largest number among the brightness repeating numbers of the brightness values of the video signal.

The comparing unit compares the output of the APL calculating unit 21 with brightness section threshold values, and outputs one of '00', '01' and '11'.

The contrast compensating method for a PDP module performed through the contrast compensating apparatus according to the present invention will be explained with reference to FIGS. 4 to 7.

As illustrated in FIG. 4, if a video signal is input, the APL of the video signal if calculated, and then the maximum value M of brightness repeating numbers of the video signal, the minimum brightness value W1 and the maximum brightness value W2 of a brightness repetition distribution area that includes the maximum value M of the brightness repeating numbers are calculated by analyzing the histogram of the video signal (step S41).

Specifically, the APL calculating unit 21 receives the video signal, calculates and outputs the APL value to the sustain pulse generating unit 22. The sustain pulse generating unit 22 generates and outputs the sustain pulses the number of which corresponds to the APL to the PDP module 20. Simultaneously, the histogram analyzing unit 23 receives and analyzes the histogram of the video signal, calculates and outputs the maximum value M of brightness repeating numbers of the video signal, the minimum brightness value W1 and the maximum brightness value W2 of the brightness repetition distribution area that includes the maximum value M of the brightness repeating numbers to the contrast compensating unit 25.

Meanwhile, the comparing unit 24 compares the APL output from the APL calculating unit 21 with the brightness section threshold values T1, T2 and T3 (See FIG. 1), respectively, and output '00', '01' and '11' to the contrast compensating unit 25 as shown in Table 1.

TABLE 1

| | Condition | Output of Comparison |
|---|---|---|
| A Section | APL ≦ T1 | 00 |
| B Section | T1 < APL ≦ T2 | 01 |
| C Section | APL > T2 | 11 |

Then, the contrast compensating unit 25 judges whether the resultant values of comparing the APL with the threshold values T1, T2 and T3 are equal to the first setting value that is the primary judgment basis of the contrast compensation of the video signal (step S42).

Figure 1:
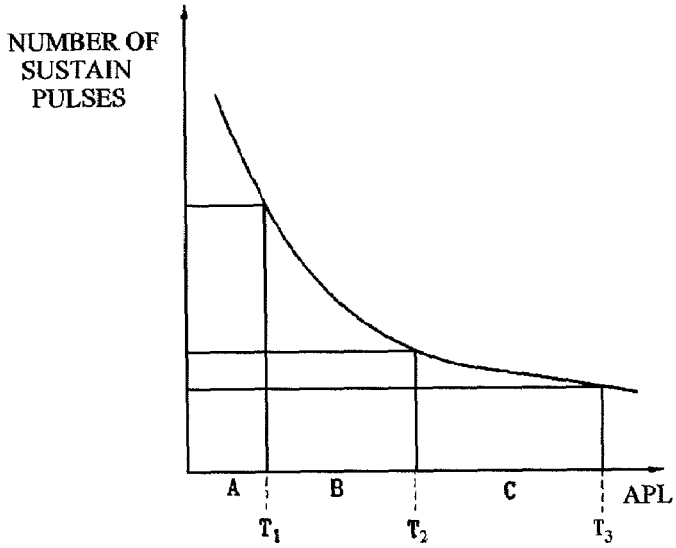
FIG. 1 (Related Art)
FIG. 1 is a graph illustrating the APL characteristic curve according to the related art.
Figure 2:
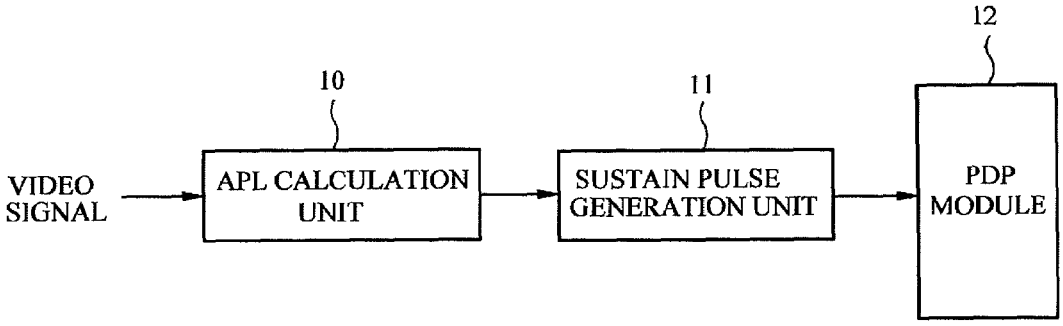
FIG. 2 (Related Art)
FIG. 2 is a block diagram illustrating the construction of a conventional brightness control apparatus for a PDP module.

In this case, the first setting value is set to '11'. If the output of the comparing unit 24 is '11', it means that the APL belongs to the 'C section', which is the section in which the contrast deterioration occurs most greatly as illustrated in FIG. 1.

If the output of the comparing unit 24 is equal to the first setting value as a result of judgment (step S42), the contrast compensating unit 25 judges whether the maximum value M of the brightness repeating numbers is larger than the second setting value that is the secondary judgment basis of the contrast compensation of the video signal (step S43).

In this case, one of the values that is above 200 (for example, 235) on the basis of 256 brightness levels (0~255) is selected as the second setting value, and this is because the contrast deterioration occurs greatly due to the brightness level by the same reason as the first setting value.

If the maximum value M of the brightness repeating numbers is larger than the second setting value as a result of judgment (step S43), the contrast compensating unit 25 calculates the contrast compensation value according to the difference between the minimum brightness value W1 and the maximum brightness value W2 (step S44).

The contrast compensation value is calculated through the following process.

A brightness compensation value corresponding to the calculated brightness difference is read with reference to a prestored brightness difference/compensation value table. Brightness level increase/decrease values of the corresponding pixels are calculated so that the brightness distribution area that includes the minimum brightness value W1 and the maximum brightness value W2 is shifted to the brightness repetition distribution area having the minimum value W1' and the maximum value W2' that are reduced as much as the brightness compensation value with its width maintained.

The reason why the brightness level increase/decrease values of the corresponding pixels are calculated is that the brightness repetition distribution of the area W1'~W2' to be shifted, which has a low brightness level, should be equal to that of the area W1~W2 before the shifting with its width maintained as it is, and thus the brightness distribution of the corresponding cells of the area W1'~W2' to be shifted should be adjusted.

Then, the contrast compensation value calculated at the step S44 is fed back to the video signal using the mixer 26 to perform the contrast compensation (step S45).

The contrast compensating process according to the present invention as described above will be explained in more detail with reference to the drawings illustrating the actual compensated video signals.

That is, if the resultant value of comparing the APL with the threshold value is equal to the first setting value (that belongs to the C section of FIG. 1) and the maximum value M of the brightness repeating numbers is larger than the second setting value, the histogram of the image as illustrated in FIG. 5 is illustrated in FIG. 6.

The histogram of FIG. 6 shows that the Wi brightness repetition distribution is W1~W2, the minimum value of the area is W1 and the maximum value is W2.

Accordingly, the calculated brightness difference, i.e., the brightness compensation value corresponding to the width of W1~W2 or the shifted width of the distribution area, is read, and the brightness level increase/decrease values of the corresponding pixels are calculated to perform the compensation.

That is, the compensation value is set according to the brightness difference in the brightness difference/compensation value table. For example, as the width of W1~W2 becomes larger (this means that a bright image is widely distributed), the corresponding compensation value becomes smaller while as the width of W1~W2 becomes smaller (this means that a bright image is narrowly distributed), the corresponding compensation value becomes larger.

Accordingly, as illustrated in FIG. 7, it can be seen that the original brightness distribution area W1~W2 is shifted by k to the brightness repetition distribution area W1'~W2' with its width maintained and with the minimum and maximum brightness repeating numbers maintained as they are.

As illustrated in FIG. 7, since the compensation-completed image has a lowered whole brightness due to the shift of the brightness repetition distribution area, the number of sustain pulses is increased in comparison to the image before the compensation, and thus the contrast deterioration is prevented.

As described above, according to the present invention, the brightness repetition distribution area is shifted in a direction in which the whole brightness level is lowered with the form and width of the area maintained as they are, and thus the contrast deterioration due to the decrease of the number of sustain pulses can be prevented to improve the picture quality.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A contrast compensating apparatus for a PDP module, comprising:

an APL (Average Picture Level) calculating unit for calculating an APL of a video signal;

a sustain pulse generating unit for generating and providing sustain pulses the number of which corresponds to an output of the APL calculating unit to the PDP module;

a histogram analyzing unit for calculating a maximum value M of brightness repeating numbers of the video signal, a minimum brightness value W1 and a maximum brightness value W2 of a brightness repetition distribution area that includes the maximum value M of the brightness repeating numbers;

a comparing unit for comparing the output of the APL calculating unit with at least one brightness section threshold value and outputting a result of comparison;

a contrast compensating unit for comparing an output of the comparing unit with a first setting value, comparing the maximum value of the brightness repeating numbers from the histogram analyzing unit with a second setting value, and calculating a contrast compensation value using the minimum brightness value W1 and the maximum brightness value W2 according to results of comparison; and a mixer for feeding an output of the contrast compensating unit back to an input terminal of the video signal, wherein the contrast compensating unit calculates the contrast compensation value in a manner that the contrast compensating unit calculates a brightness difference between the minimum brightness value W1 and the maximum brightness value W2, reads a brightness compensation value corresponding to the calculated brightness difference with reference to a pre-stored brightness difference / compensation value table, and calculates brightness level increase/decrease values of corresponding pixels so that a brightness distribution area that includes the minimum brightness value W1 and the maximum brightness value W2 is shifted to a brightness repetition distribution area having a minimum value W1' and a maximum value W2',the minimum value W1' and the maximum value W2' being values reduced from the minimum brightness value W1 and the maximum brightness value W2 by as much as the brightness compensation value, respectively.

2. A contrast compensating method for a PDP module, comprising the steps of:

calculating an APL (Average Picture Level) of a video signal, a maximum value M of brightness repeating numbers of the video signal, a minimum brightness value W1 and a maximum brightness value W2 of a brightness repetition distribution area that includes the maximum value M of the brightness repeating numbers;

primarily judging whether a contrast compensation of the present video signal is required according to the calculated APL;

if the contrast compensation is required as a result of primary judgment, secondarily judging whether the contrast compensation of the present video signal is required according to the maximum value M of the brightness repeating numbers;

if the contrast compensation is required as a result of secondary judgment, calculating a compensation value using the minimum brightness value W1 and the maximum brightness value W2; and performing the contrast compensation by feeding the calculated compensation value back to an input terminal of the original video signal, wherein the step of calculating the compensation value using the minimum brightness value W1 and the maximum brightness value W2 comprises the substeps of:

calculating a brightness difference between the minimum brightness value W1 and the maximum brightness value W2;

reading brightness compensation value corresponding to the calculated brightness difference with reference to a pre-stored brightness difference/compensation value table; and calculating brightness level increase/decrease values of corresponding pixels so that a brightness distribution area that includes the minimum brightness value W1 and the maximum brightness value W2 is shifted to a brightness repetition distribution area having a minimum value W1' and a maximum value W2', the minimum value W1' and the maximum value W2' being values reduced from the minimum, brightness value W1 and the maximum brightness value W2 by as much as the brightness compensation value, respectively.

3. The contrast compensating method as claimed in claim 2, wherein the first judging step comprises the substeps of:

comparing the APL value with at least one brightness section threshold value; and if the APL value is larger than a preset brightness threshold value, judging that the contrast compensation is required.

4. The contrast compensating method as claimed in claim 2, wherein the second judging step judges that the contrast compensation is required if the maximum brightness repeating number is larger than a preset repeating number.

* * * * *